US005240149A

United States Patent [19]

Schmidt

[11] Patent Number: 5,240,149

[45] Date of Patent: Aug. 31, 1993

[54] CLOSURE CAP

[75] Inventor: Karl-Heinz Schmidt, Hemer, Fed. Rep. of Germany

[73] Assignee: Perfect-Valois Ventil GmbH, Dortmund-Wickede, Fed. Rep. of Germany

[21] Appl. No.: 698,838

[22] Filed: May 10, 1991

[30] Foreign Application Priority Data

May 14, 1990 [DE] Fed. Rep. of Germany ..... 4015480

[51] Int. Cl.[5] ..... B65D 37/00

[52] U.S. Cl. ..... 222/212; 137/102; 137/512.4; 222/215; 222/494

[58] Field of Search ..... 222/206, 211, 212, 213, 222/215, 481, 482, 491, 494, 544; 137/103, 512.4

[56] References Cited

U.S. PATENT DOCUMENTS

| | | | |
|---|---|---|---|
| 2,752,199 | 6/1956 | Newell, Jr. | 222/211 X |
| 3,221,945 | 12/1965 | Davis, Jr. | 222/212 X |
| 4,098,434 | 7/1978 | Uhlig | 222/212 X |
| 4,147,306 | 4/1979 | Bennett | 222/212 X |
| 4,646,945 | 3/1987 | Steiner et al. | 222/212 X |

FOREIGN PATENT DOCUMENTS 1579213 11/1980 United Kingdom .

*Primary Examiner*—Andres Kashnikow
*Assistant Examiner*—Joseph A. Kaufman
*Attorney, Agent, or Firm*—Dressler, Goldsmith, Shore, Sutker & Milnamow, Ltd.

[57] ABSTRACT

The invention relates to a closure cap (5) having a dispensing opening (6) for containers with flexible walls, which can be pressed together by hand for the dispensing of spray product which is in connection with the dispensing opening (6) by means of a dip tube (7). Upstream of the dispensing opening (6) is an outlet valve (8), which is open when there is positive pressure in the container, whereas an air-admitting opening (9) is assigned an air-admitting valve (10), which is open when there is negative pressure in the container. By virtue of the outlet valve (8) upstream of the dispensing opening (6), the readmission of air to the container and consequently the risk of sucking in through the dispensing opening (6) substances contaminating the container content is prevented. Maintaining the quality of the spray product in the container is ensured by virtue of the air-admitting opening (9), separate from the dispensing opening (6), and the air-admitting valve (10), which opens only when there is negative pressure in the container.

7 Claims, 2 Drawing Sheets

CLOSURE CAP

FIELD OF THE INVENTION

The invention relates to a closure cap containing a valve assembly that is opened to dispense product from a container when flexed and which will open to admit air into the container when there is a negative pressure in the container.

BACKGROUND OF THE INVENTION

Closure caps of the abovementioned generic type are generally known. They permit the dispensing of liquid or powdered spray product by pressing in one or more flexible walls of the container. Due to the so-called memory character of the walls, the latter have the tendency to resume their original position when the container is released. Associated with this is a sucking-in of air through the dispensing opening of the closure cap. This effect may entail disadvantages, if for example the pack equipped with the closure cap is used for medical purposes in which a curative or remedial preparation has to be dispensed by introducing the front end of the closure cap, containing the dispensing opening, into a body orifice. In this case the possibility cannot be ruled out that, while the closure cap with its dispensing opening is still inserted in the body orifice, fluid in the body orifice is sucked in by the readmission of air into the container and leads to a contamination of the product contained in the container. For instance, for combating colds, so-called nasal spray systems are known in which, after spraying the spray into the nose, nasal secretion is sucked in by the readmission of air to the container and, as a result, the product is contaminated.

SUMMARY OF THE INVENTION

The invention is therefore based on the object of improving a closure cap of the said generic type in such a way that the admission of air to the container through the dispensing opening after pressing its flexible walls together is prevented, but nevertheless a cost-effective mass production of the closure cap is possible by virtue of a simple design of the closure cap.

The invention achieves this object by the features described and illustrated in the application. By virtue of the arrangement of the outlet valve upstream of the dispensing opening, which valve is open only when positive pressure prevails in the container, the readmission of air to the container and consequently the risk of sucking in through the dispensing opening substances contaminating the container content is reliably prevented. This is so because maintaining the quality of the spray product in the container is ensured by virtue of the air-admitting opening, separate from the dispensing opening, and the air-admitting valve, which opens only when there is negative pressure in the container.

The connecting opening between the chamber joining the dip tube to the dispensing opening and the upper, air-containing part of the container permits a mixing of the active product with the air pressed out of the upper part of the container through the connecting opening. This mixing effect is of course achieved in particular when the container content comprises a liquid, meaning that the closure cap is suitable in particular for liquids as the active product.

The various claims disclose advantageous designs of the closure cap, which is specified as comprising only four individual parts, namely the actual closure cap, a dip tube holder, a single flexible valve component, which at the same time provides the valve parts for the outlet valve and for the air-admitting valve, as well as the dip tube. Consequently, an extremely inexpensive and cost-effective mass production of the closure according to the invention is possible.

BRIEF DESCRIPTION OF THE DRAWINGS

The invention is explained in greater detail below with reference to the drawings of two illustrative embodiments, in which.

DETAILED DESCRIPTION

Figure 1:
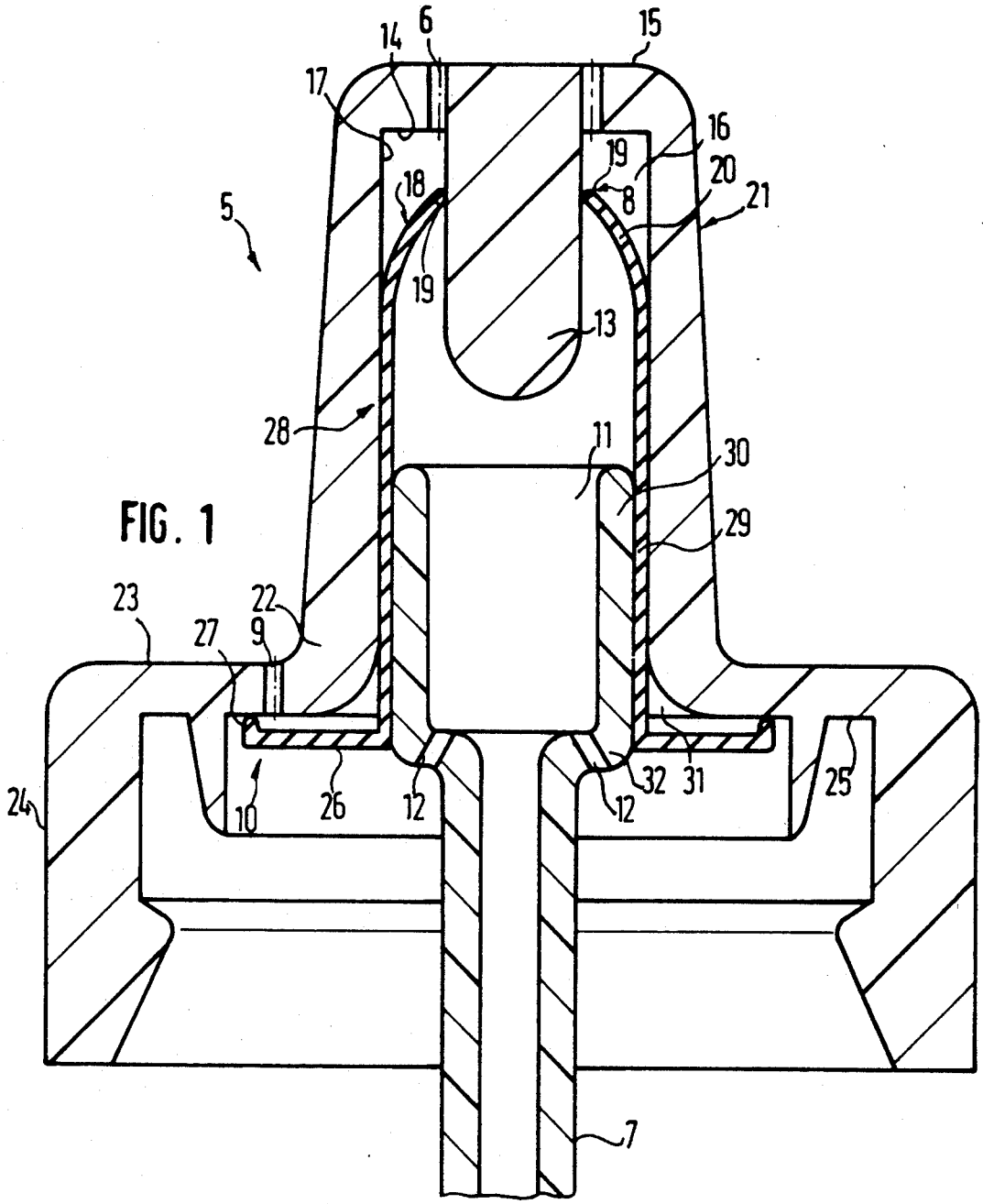
FIG. 1 shows a first embodiment of a closure cap in a central longitudinal section and FIG. 2 shows a second embodiment of the closure cap in a central longitudinal section.
Figure 2:
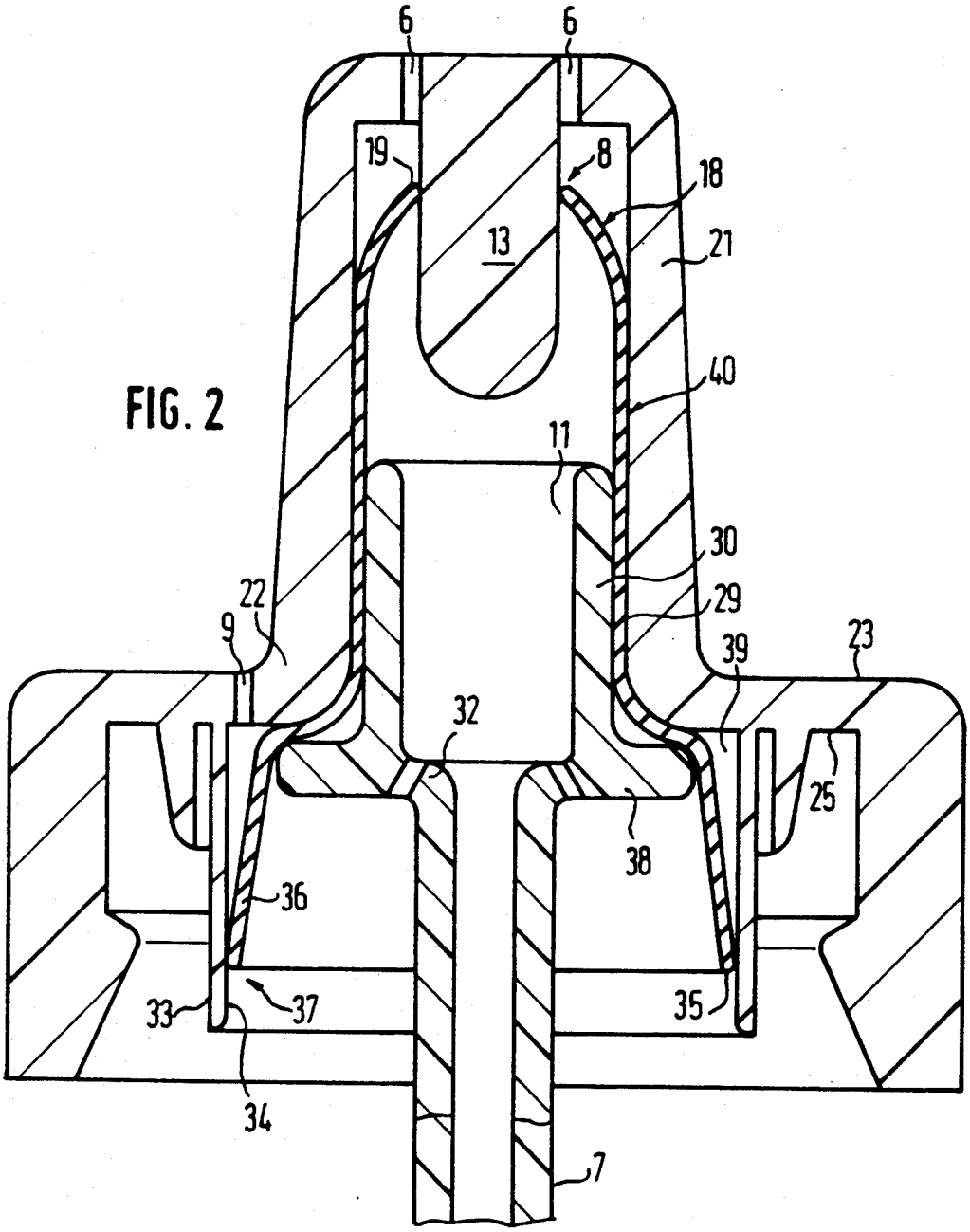

FIGS. 1 and 2 show a closure cap 5 for a squeeze-bottle nasal spray system having two dispensing openings 6 for a container (not shown), preferably of plastic, with flexible walls, which can be pressed together by hand for dispensing a liquid therapeutic agent, for example for reducing the swelling of the nasal nucous membranes, which agent is in connection with the dispensing openings 6 by means of a dip tube 7. Instead of a liquid spray product, if appropriate a powdered spray product may also come into consideration.

Upstream of the dispensing openings 6 there is an outlet valve 8, which is open when there is positive pressure in the container. According to FIG. 1, an air-admitting opening 9 is assigned an air-admitting valve 10, which is open when there is negative pressure in the container. A chamber 11 joins the dip tube 7 to the dispensing opening 6 and is in connection with the upper, air-containing part of the container via at least one connecting opening 12.

The valve seat of the outlet valve 8 is formed by a cylindrical plug 13, which protrudes coaxially from the underside 14 of a top wall 15 into the cylindrical chamber 11. The cylindrical plug 13 forms with the chamber wall 17 of the chamber 11 an annular space 16. Fastened to the chamber wall 17 is a flexible valve part 18, which bears with a circular, central hole rim 19 tightly against the circumferential surface of the plug 13.

The flexible valve part 18 of the outlet valve 8 extends from the chamber wall 17 to the hole rim 19 in the direction of the dispensing opening 6 in the form of a round crown 20. As can be seen, the dispensing openings 6 are arranged in the top wall 15 of the chamber 11, which is formed by a centrally rising cap dome 21. A base 22 of the cap dome 21 is surrounded by an annular shoulder 23, which has in the base region the connecting opening 12. A cap jacket 24 extends downward from the outer rim of the annular shoulder 23 approximately coaxially to the central longitudinal axis of the closure cap 5, and is shaped in such a way that it can be fitted with a press fit or snap fit onto the container neck. Alternatively, a screw connection may also be chosen.

According to FIG. 1, the underside 25 of the annular shoulder 23, radially outside the air-admitting opening 9, forms the valve seat for a flexible valve part 26 of the air-admitting valve 10. The flexible valve part 26 is fastened to the chamber wall 17 and extends in the manner of an annular disk approximately parallel to the annular shoulder 23 radially outward beyond the air-admitting opening 9 and is provided on the outer rim with a rising sealing lip 27.

Although the flexible valve parts 18 and 26 are designed as separate entitles and can be fastened independently of each other in the chamber, for example mechanically or by adhesion or heat sealing, it is preferred for them to form a single valve component 28. This valve component 28 is preferably produced from very soft polyethylene, rubber or silicone. The valve component 28 comprises a cylindrical section 29, which extends along the chamber wall 17 and connects the upper round crown 20 of the outlet valve 8 to the annular-disk-shaped valve part 26 of the air-admitting valve 10. This permits production of the closure cap from just a few individual parts with very simple assembly.

A cylindrical dip tube holder 30 is fitted into the lower opening 31 of the chamber 11 and applies the two flexible valve parts 18 and 26 of the outlet valve 8 and of the air-admitting valve 10, respectively, which form the one-part valve component 28, firmly against the chamber wall 17 with a press fit. At 32, the dip tube holder 34 is widened in relation to the diameter of the dip tube 7 provided at its lower end. In this widening region 32, two diametrally opposite connecting openings 12 are provided. These connecting openings permit during pressing-together of the container the exiting of air out of the container into the chamber 11 as well as the mixing with the spray product in the chamber before it is sprayed out of the dispensing openings 6. It goes without saying that there may also be only one or more than two connecting openings.

If liquid contained in the flexible container is to be dispensed through the dispensing opening 6 by pressing the container together, the positive pressure thereby produced in the container has on the one hand the effect of keeping the air-admitting valve 10 tightly closed, while on the other hand it has the effect that the positive pressure presses the, for example liquid, container content through the dip tube 7 and the chamber 11 against the hole rim 19 of the flexible valve part 18, which is lifted off the cylindrical circumferential surface of the plug 13, so that the liquid can flow out through the two dispensing openings 6 adjacent parallel to the plug 13. The liquid flows out as a spray mist, because air contained in the upper part of the container has been mixed with the spray liquid through the connecting opening 12 in the chamber 11. When the exertion of pressure has ended, the outlet valve 8 closes itself. The container wall then reverts to its original position by virtue of its resilience. The valve part 26 is lifted off the air-admitting opening 9 by virtue of the low pressure in the container in comparison with the atmosphere pressure, so that the part of the container free from liquid is filled with air until the pressure is equalized. As soon as pressure equalization has been achieved, the flexible valve part 26 of the air-admitting valve 10 closes itself automatically.

In the case of the second embodiment according to FIG. 2 of a closure cap, parts corresponding to the first embodiment are provided with the same reference numerals.

It can be seen that, in the case of this second embodiment, an air-admitting valve 37 is of a different design. A cylindrical sealing collar 33 protrudes coaxially with respect to the chamber 11 downward from the underside 25 of the annular shoulder 23 and surrounds the air-admitting opening 9. The inside wall 34 of the sealing collar 33 forms the valve seat for the outer rim 35 of a flexible valve part 36 of the air-admitting valve 37. A dip tube holder 30 is of essentially the same design as that in FIG. 1, but has in addition, in one transitional region 32 to the dip tube 7, an annular flange 38 on the outside. The residue of this annular flange 38 is dimensioned such that it is smaller than the radial distance of the air-admitting opening 9 from the central longitudinal axis of the closure cap 5. The annular flange 38 is arranged at an axial distance from the underside 25 of the annular shoulder 23 in such a way that the flexible valve part 36 of the air-admitting valve 37 extends downward over the annular flange 38 through an annular gap 39 between the annular flange and the sealing collar 33 and outward toward the inside wall 34 of the latter and, in the closed position, bears tightly against said wall. In comparison with the embodiments shown in FIG. 1, this embodiment has the advantage that the air-admitting valve 37 responds more sensitively or more quickly than in the case of the first embodiment. Moreover, it is better in terms of technical flow aspects. In addition, the shape of the one-part valve component 40 in FIG. 2 permits easier production by the injection-molding process, since the changes in diameter from the valve part 36 via the cylindrical section 29 to the upper hole rim 19 are gradual.

In the case of both embodiments, the closure cap itself preferably consists of polyethylene, polypropylene or other thermoplastic materials. The closure cap may be fitted by means of a snap fit or a press fit onto a corresponding designed container neck or screwed by means of a screw closure onto a container neck provided with a thread. The dip tube holder and the dip tube may also be produced from corresponding materials.

The dip tube holder 30, on which the dip tube 7 is mounted, as well as the flexible, one-part valve component 28 or 40 are held in the chamber 11 of the cap dome 21 of the closure cap by a press fit.

On actuation, it is true of both embodiments that pressure on the container causes the active spray product, preferably liquid, to be passed through the dip tube 7 and the dip tube holder 30 into the chamber 11. At the same time, air, which is inside the container above the active product, passes through the connecting opening 12 of the dip tube holder 30 likewise into the chamber 11, where it mixes with the active product.

The hydraulic pressure of the active liquid intermixed with air causes the hole rim 19 to be lifted off the plug 13 and consequently causes the outlet valve 8 to be opened. The product can then exit through the dispensing openings 6. Immediately after ending the pressing-together of the container, by virtue of the negative pressure in the container in comparison with the outside pressure, the outlet valve 8 between the valve part 18 and the plug 13 is closed again and consequently, for example in the case of a nose spray bottle, a sucking-in of nasal secretion through the dispensing openings 6 is prevented. At the same time, the negative pressure prevailing in the container likewise causes the air-admitting valve 10 or 37 to be opened, by lifting off the sealing lip 27 or the outer rim 35 of the valve parts concerned from their valve seat, so that air passes through the air-admitting opening 9 in the closure cap into the container and can fill the latter with air again. Furthermore, it can be seen that the assembly of the closure cap merely requires a successive coaxial assembling movement of the one-part of valve component 28 or 40, of the dip tube holder with a press fit and of the dip tube 7.

I claim:

1. A closure cap having a top wall defining a dispensing opening for containers with flexible walls, which walls can be pressed together by hand for dispensing a spray product, a dip tube assembly disposed in said cap and adapted to extend into said container, said cap defining a cylindrical chamber, a valve seat interiorly of said cap adjacent said dispensing opening formed by a cylindrical plug that protrudes coaxially from the underside of the top wall into the cylindrical chamber and forming an annular space with the chamber wall, said cap further defining a passageway between the exterior of the cap and the container for admitting air to the container, and a valve means for controlling flow between said dip tube assembly and dispensing opening comprising a first flexible valve member which bears against the circumferential surface of the plug and a second flexible valve member that normally closes off said passageway but opens when a negative pressure exists in the container.

2. A closure cap as set forth in claim 1 wherein the first flexible valve member extends from the chamber wall to the cylindrical plug in the manner of a crown in the direction of the dispensing opening.

3. A closure cap having a dispensing opening for containers with flexible walls, which walls can be pressed together by hand for dispensing a spray product, a dip tube assembly disposed in said cap and adapted to extend into a container, an outlet valve including a flexible valve member within said cap and located between said dispensing opening and said dip tube assembly for controlling the flow therebetween, said dip tube assembly defining at its upper end a chamber and an unobstructed passage between the container and said chamber, said cap also forming a cylindrical chamber formed by a centrally rising cap dome, the base of which is surrounded by an annular shoulder and includes a cap jacket that extends downwardly from the outer rim of the annular shoulder approximately coaxial to the cylindrical chamber formed by the closure cap, said cap further defining a passageway between the exterior of the cap and said container for admitting air to said container, valve means for controlling flow through said passageway, said passageway being located in the annular shoulder and the cap further defining a cylindrical sealing collar that protrudes coaxially with respect to the cap chamber downwardly from the underside of the annular shoulder outside said passageway with the inside wall of said sealing collar forming a valve seat for an outer rim defined by the annular flexible valve member forming part of said valve means that is fastened to the cap chamber wall.

4. A closure cap as set forth in claim 3 wherein the dip tube assembly includes a cylindrical holder fitted into the lower opening of the cap chamber and the flexible valve members of the outlet valve and the valve means are pressed firmly against the cap chamber wall.

5. A closure cap as set forth in claim 4 wherein the flexible valve members of the outlet valve and valve means form a single valve component.

6. A closure cap as set forth in claim 4 wherein the dip tube holder in said chamber is cylindrical and widened in relation to the diameter of the dip tube provided at its lower end, and said unobstructed passage interconnecting the container and said chamber is provided in the widened region.

7. A closure cap as set forth claim 6 wherein the dip tube holder has in the transitional region to the dip tube an annular flange, the radius of which flange is dimensioned such that it is smaller than the radial distance of the passageway from the central longitudinal axis of the closure cap, the annular flange being arranged an axial distance from the underside of the annular shoulder in such a way that the flexible valve part of the valve means extends downward over the annular flange through an annular gap between the annular flange and sealing collar outwards toward the inside wall of the sealing collar and bears tightly against said inside wall.

* * * * *